US007299857B2

(12) United States Patent
Schlichting et al.

(10) Patent No.: US 7,299,857 B2
(45) Date of Patent: Nov. 27, 2007

(54) METHOD AND APPARATUS FOR LOCALIZED CONTROL OF HEAT FLUX IN THIN CAST STRIP

(75) Inventors: Mark Schlichting, Crawfordsville, IN (US); Walter Blejde, Brownsburg, IN (US); Eugene B. Pretorius, Mt. Pleasant, SC (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/302,485

(22) Filed: Dec. 13, 2005

(65) Prior Publication Data

US 2006/0237162 A1 Oct. 26, 2006

Related U.S. Application Data

(63) Continuation-in-part of application No. 11/010,625, filed on Dec. 13, 2004, now abandoned.

(51) Int. Cl.
*B22D 11/06* (2006.01)

(52) U.S. Cl. ..... 164/480; 164/428

(58) Field of Classification Search ..... 164/479–482, 164/428–429, 431–432
See application file for complete search history.

(56) References Cited

U.S. PATENT DOCUMENTS

| | | | |
|---|---|---|---|
| 3,345,738 | A | 10/1967 | Mizikar et al. |
| 3,795,025 | A | 3/1974 | Sadamitsu |
| 4,250,950 | A | 2/1981 | Buxmann et al. |
| 4,301,855 | A | 11/1981 | Suzuki et al. |
| 4,368,084 | A | 1/1983 | Irie et al. |
| 4,530,597 | A | 7/1985 | Itaya et al. |
| 4,588,021 | A | 5/1986 | Bergeron et al. |
| 4,793,400 | A | 12/1988 | Wood |

(Continued)

FOREIGN PATENT DOCUMENTS

| | | |
|---|---|---|
| EP | 0309247 | 3/1989 |

(Continued)

OTHER PUBLICATIONS

International Search Report for PCT/IB2005/054225.

(Continued)

*Primary Examiner*—Kuang Y. Lin
(74) *Attorney, Agent, or Firm*—Hahn Loeser & Parks LLP; Arland T. Stein

(57) ABSTRACT

A method of and apparatus for localized control of heat flux in continuous casting of thin cast strip comprising removing oxides from the casting surface of each casting roll by contacting the casting surface of each casting roll with the rotating brush in advance of the casting area, and delivering gas at the casting surface between the rotating brush and entry to the casting area to form a gas layer on the casting surface of each casting roll where the oxides have been removed. The delivering of gas at the casting surface between the rotating brush and entry to the casting area is preferably done in at least three zones along the casting roll axes to form a gas layer on the casting surface of each casting roll where the oxides have been removed, where the gas projected in the respective zones can be of different composition, mixture, pressure, or combination thereof.

34 Claims, 14 Drawing Sheets

U.S. PATENT DOCUMENTS

| | | | |
|---|---|---|---|
| 4,865,117 | A | 9/1989 | Bartlett et al. |
| 4,887,662 | A | 12/1989 | Tanaka et al. |
| 4,934,443 | A | 6/1990 | Honeycutt et al. |
| 4,986,336 | A | 1/1991 | Fukase et al. |
| 5,103,895 | A | 4/1992 | Furuya et al. |
| 5,227,251 | A | 7/1993 | Suichi et al. |
| 5,307,861 | A | 5/1994 | Townsend |
| 5,366,001 | A | 11/1994 | Freedman et al. |
| 5,368,088 | A | 11/1994 | Furuya et al. |
| 5,520,243 | A | 5/1996 | Freeman et al. |
| 5,575,327 | A | 11/1996 | Kato |
| 5,588,479 | A | 12/1996 | Leadbeatter et al. |
| 5,590,701 | A | 1/1997 | Fukase |
| 5,651,413 | A | 7/1997 | Williams et al. |
| 5,660,224 | A | 8/1997 | Barbe et al. |
| 5,701,948 | A | 12/1997 | Strezov et al. |
| 5,720,336 | A | 2/1998 | Strezov |
| 5,787,967 | A | 8/1998 | Vendeville et al. |
| 5,964,277 | A | 10/1999 | Tanaka et al. |
| 6,059,014 | A | 5/2000 | Strezov |
| 6,120,621 | A | 9/2000 | Jin et al. |
| 6,886,623 | B2 | 5/2005 | Kato et al. |
| 7,073,565 | B2 | 7/2006 | Nikolovski et al. |
| 2002/0088602 | A1 | 7/2002 | Kato et al. |
| 2002/0166653 | A1 | 11/2002 | Yamamura et al. |

FOREIGN PATENT DOCUMENTS

| | | |
|---|---|---|
| EP | 0 409 645 | 1/1991 |
| EP | 0523643 | 1/1993 |
| EP | 0714716 | 5/1996 |
| EP | 0800881 | 10/1997 |
| EP | 0 865 850 | 9/1998 |
| EP | 0 887 145 | 12/1998 |
| FR | 1364717 | 6/1964 |
| FR | 2 771 034 | 5/1999 |
| JP | 56-062660 | 5/1981 |
| JP | 58-058963 | 4/1983 |
| JP | 60-040650 | 3/1985 |
| JP | 3-128149 | 5/1991 |
| JP | 3-230849 | 10/1991 |
| JP | 4-041052 | 2/1992 |
| JP | 4-066247 | 3/1992 |
| JP | 5-177311 | 7/1993 |
| JP | 6-134553 | 5/1994 |
| JP | 8-294751 | 11/1996 |
| JP | 29393 | 2/1997 |
| JP | 29394 | 2/1997 |
| JP | 2001-58245 | 3/2001 |
| JP | 2002-113555 | 4/2002 |
| JP | 2002-210544 | 7/2002 |
| KR | 2003 052333 | 6/2003 |
| RU | 2030957 | 3/1995 |
| WO | 9402269 | 3/1994 |
| WO | 03/055624 | 7/2003 |
| WO | 2004/065039 | 8/2004 |

OTHER PUBLICATIONS

Written Opinion for PCT/IB2005/054225.
International Search Report for PCT/IB2005/054226.
Written Opinion for PCT/IB2005/054226.

METHOD AND APPARATUS FOR LOCALIZED CONTROL OF HEAT FLUX IN THIN CAST STRIP

RELATED APPLICATION

This application is a continuation-in-part of application Ser. No. 11/010,625, filed Dec. 13, 2004, now abandoned.

BACKGROUND AND SUMMARY OF THE INVENTION

This invention relates to the casting of steel strip by a single or a twin roll caster. In a twin roll caster, molten metal is introduced between a pair of counter-rotated horizontally positioned casting rolls, which are internally cooled so that metal shells solidify on the moving roll surfaces and are brought together at the nip between them to produce a thin cast strip product delivered downwardly from the nip. The term "nip" between the casting rolls is used herein to refer to the general region at which the rolls are closest together. The molten metal may be poured from a ladle into a smaller vessel, from which it flows through a metal delivery nozzle located above the nip forming a casting pool of molten metal supported on the casting surfaces of the rolls. This casting pool is usually confined between side plates or dams held in sliding engagement with end surfaces of the rolls so as to dam the two ends of the casting pool against outflow.

When casting steel strip in a twin roll caster, the casting pool will generally be at a temperature in excess of 1550° C., and usually 1600° C. and greater. It is necessary to achieve very rapid cooling of the molten steel over the casting surfaces of the rolls in order to form solidified shells in the short period of exposure on the casting surfaces to the molten steel casting pool during each revolution of the casting rolls. Moreover, it is important to achieve even solidification so as to avoid distortion of the solidifying shells which come together at the nip to form the steel strip. Distortion of the shells can lead to surface defects known as "crocodile skin surface roughness." Crocodile skin surface roughness is known to occur with high carbon levels above 0.065%, and even with carbon levels below 0.065% by weight carbon. Crocodile skin roughness, as illustrated in FIG. 1, is known to occur for other reasons. Crocodile skin roughness involves periodic rises and falls in the strip surface of 40 to 80 microns, in periods of 5 to 10 millimeters, measured by profilometer.

We have found that with carbon levels below 0.065% by weight the formation of crocodile skin surface roughness is directly related to the heat flux between the molten metal and the surface of the casting rolls, and that the formation of crocodile skin roughness can be controlled by controlling the heat flux between the molten metal and the surface of the casting rolls. FIG. 2 reports dip tests that illustrates the relationship between the heat flux and the formation of crocodile skin roughness during the formation of the metal shells on the surfaces of the casting rolls in making the thin cast strip. As shown by FIG. 2, we have also found that by controlling the energy exerted by rotating brushes peripherally in contact with the casting surfaces of each casting roll, heat flux between the molten metal and the surface of the casting rolls, and in turn crocodile skin surface roughness on the resulting thin cast strip can be controlled.

This relationship between the heat flux from the molten metal and the surface of the casting rolls and the formation of crocodile skin surface roughness on the thin cast strip has been found to occur whether the casting roll surfaces are smooth or textured. FIG. 3 reports dip tests that illustrate how the heat flux is changed with both smooth and textured casting surfaces on the casting rolls. We have also found that the texture of the casting roll surfaces of the casting rolls change during casting. This change can cause a change in heat flux from the molten metal to the casting roll surfaces and in turn a change in formation of crocodile skin surface roughness on the thin cast strip. We have found a method of directly controlling the formation of crocodile skin surface roughness by controlling the heat flux between the molten metal and the casting roll surfaces, to avoid high fluctuations in the heat flux during the formation of the metal shells during casting and in turn control the forming of crocodile skin surface roughness in the thin cast strip produced.

The energy of the rotating brush against the casting roll may be in turn controlled based on the casting speed by varying the application pressure or the speed of rotation, or both, of an electric, pneumatic or hydraulic motor rotating the brush against the casting surface. The energy of the rotating brush can be measured by measuring the torque of the motor rotating. The heat flux between the molten metal and the casting surfaces of the casting rolls may be initially measured and continually measured, as well as the difference between the real time heat flux and the initial heat flux measured, by measuring the difference in temperature of the cooling water circulated through the casting roll between the inlet and outlet as described in U.S. Pat. Nos. 6,588,493 and 6,755,234. Although this is the best way presently contemplated for measuring the heat flux, the heat flux can be measured by any available method. In any event, by monitoring the heat flux and calculating the difference in heat flux from the initial heat flux measured, the energy exerted by the brush against the casting surface can be automatically controlled by a control system that receives electrical signals from the monitor corresponding to the measured heat flux, and controls the energy exerted by the brush against the casting roll based in the difference in heat flux from the initial heat flux measured.

It was previously proposed to project gas in the casting area adjacent the casting surface to adjust the shape of the crown of the casting rolls. See U.S. Pat. No. 5,787,967. However, it has not been proposed project gas on the casting surfaces of the casting rolls in the vicinity of where brushes remove oxides from the casting surfaces to improve localized heat flux between the molten metal and the casting roll surface in the casting area. The casting area is the area between the casting rolls above the nip where the casting pool is formed. It is the area from the twelve o'clock position on the casting rolls where the seal is formed, typically with gas curtains, as the rotating casting roll surface enter the casting area, and does not include the area adjacent the casting rolls between the discharge of cast strip from the nip and the twelve o'clock position on the casting rolls.

We have delivered gas to the casting surface of the casting rolls to create a gas layer adjacent the casting surface immediately following brushing of oxides from the casting surface. A method of localized control of heat flux in continuous casting of thin cast strip is disclosed that comprises the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip to form a casting area;

assembling a rotating brush peripherally to contact the casting surface of each casting roll in advance of contact of the casting surfaces with the molten metal in the casting pool;

removing oxides from the casting surface of each casting roll by contacting the casting surface of each casting roll with the rotating brush;

delivering gas to the casting surface between the rotating brush and entry to the casting area to form a gas layer on the casting surface of each casting roll where the oxides have been removed; and counter-rotating the casting rolls such that the casting surfaces of the casting rolls each travel toward the nip to produce a cast strip downwardly from the nip.

The steps of removing oxides from the casting surface of each casting roll and delivering gas on the casting surface of each casting roll may occur simultaneously in the nip between the rotating brush and the casting surface of the casting roll. The gas also, or in the alternative, may be introduced upstream of the rotating brush adjacent the brush. In addition, the step of forming a gas layer may comprise introducing the gas into a housing provided about the rotating brush. Alternatively, the step of forming the gas layer on the casting surface of each casting roll to replace the removed oxides may comprise flooding with a gas the casting surface adjacent rotating brush before entry to the casting area.

The gas may comprise at least one gas selected from the group consisting of nitrogen, argon, hydrogen, carbon monoxide, water vapor, dry air, helium or a mixture of two or more thereof.

The casting surfaces of the casting rolls may be textured with a random distribution of discrete projections. Portions of the projections may or may not extend above the gas layer.

Alternatively, a method of localized control of heat flux in continuous casting of thin cast strip is disclosed comprising the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip to form a casting area;

assembling a rotating brush peripherally to contact the casting surface of each casting roll in advance of the casting area;

removing oxides from the casting surface of each casting roll by contacting the casting surface of each casting roll with the rotating brush;

delivering gas to the casting surface between the rotating brush and entry to the casting area in at least three zones extending along the casting surfaces of the casting rolls to form a gas layer on the casting surface of each casting roll where the oxides have been removed; and counter-rotating the casting rolls such that the casting surfaces of the casting rolls each travel toward the nip to produce a cast strip downwardly from the nip.

The gas projected in the respective zones may be different in composition, mixture, pressure, or at least two thereof the delivering of the gas on the casting surface. Further, the gas may be projected in at least five zones extending along the casting surfaces of the casting rolls. In any event, the delivering of the gas on the casting surface of each casting roll may be adjacent the nip formed between the rotating cleaning brush and the casting surface of the casting roll. The delivering of the gas to form a gas layer may comprise introducing the gas into a housing provided about the rotating brush. Also, the step of delivering gas to the casting surface of each casting roll to replace the removed oxides may comprise flooding the casting surfaces adjacent the rotating brushes with a gas.

The casting surfaces of the casting rolls are textured with a random distribution of discrete projections. Again, portions of the projections may or may not extend above the gas layer.

The gas nozzles may be capable of delivering in the respective zones different gas compositions, gas mixtures, pressures, or at least two thereof. Again, the gas may comprise at least one gas selected from the group consisting of nitrogen, argon, hydrogen, helium, water vapor, dry air, carbon monoxide, carbon dioxide or a mixture of two or more thereof Further, an apparatus for continuously casting thin cast strip is disclosed that comprises:

a pair counter-rotating casting rolls having circumferential casting surfaces laterally spaced to form a nip therebetween through which thin cast strip may be discharged downwardly, and capable of supporting a casting pool of molten metal on the circumferential casting surfaces adjacent the nip to form a casting area;

rotating brushes capable of removing oxides from the casting roll surfaces of each casting roll, positioned to remove such oxides from the casting surfaces in an area away from the casting area; and gas nozzles capable of directing gas on the casting surface of each casting roll between the brush and the casting area to form a gas layer where oxides have been removed from the casting surfaces of the casting rolls.

The apparatus for continuously casting thin cast strip claimed may have the gas nozzles capable of delivering gas adjacent the rotating brush, and flooding the casting surface of each casting roll adjacent the brush with gas. In addition, a housing may be provided about each rotating brush that also supports at least some of the gas nozzles.

Alternatively, an apparatus for continuously casting thin cast strip is disclosed that comprises:

a pair counter-rotating casting rolls having circumferential casting surfaces laterally spaced to form a nip therebetween through which thin cast strip may be discharged downwardly, and capable of supporting a casting pool on the circumferential casting surfaces adjacent the nip to form a casting area;

rotating brushes capable of removing oxides from the casting roll surfaces of each casting roll, positioned to remove such oxides from the casting surfaces in an area away from the casting area;

a control system capable of measuring and controlling a desired degree of cleaning of the casting surfaces of the casting rolls with a majority of projections on the casting surfaces exposed and provide wetting contact between the casting surface and the molten metal of the casting pool by controlling the energy exerted by the rotating brushes during a casting campaign; and gas nozzles capable of directing gas on the surface of the casting rolls adjacent the brushes to form a gas layer where oxides have been removed from the casting surfaces of the casting rolls.

The apparatus for continuously casting thin cast strip may have the gas nozzles capable of directing gas on the surface of the casting rolls to flood the area adjacent the position of the brushes before the casting area.

Alternatively, an apparatus for continuously casting thin cast strip with localized heat flux control is disclosed comprising:

a pair counter-rotating casting rolls having circumferential casting surfaces laterally spaced to form a nip therebetween through which thin cast strip may be discharged downwardly, and capable of supporting a casting pool on the circumferential casting surfaces adjacent the nip to form a casting area;

rotating brushes capable of removing oxides from the casting surfaces of each casting roll positioned in an area away from the casting area; and gas nozzles capable of delivering gas at the casting surface between the rotating brush and entry to the casting area in at least three zones extending long the casting surface of each casting roll to form a gas layer on the casting surface of each casting roll where the oxides have been removed.

The gas nozzles may be capable of delivering in the respective zones different gas compositions, gas mixtures, pressures, or at least two thereof. The gas nozzles may be capable of delivering of the gas on the casting surface in at least five zones along the casting surface of the casting roll. Also, the gas nozzles may be capable of delivering of the gas on the casting surface of each casting roll adjacent the nip formed between the rotating cleaning brush and the casting surface of the casting roll. Further, the gas nozzles may be capable flooding the casting surfaces adjacent the rotating brushes with a gas. In addition, a housing may be provided about the rotating brush, and the gas nozzle may capable of delivering the gas to form a gas layer through the housing.

Again, the casting surfaces of the casting rolls may be textured with a random distribution of discrete projections.

The gas may comprise at least one gas selected for the group consisting of: nitrogen, argon, hydrogen, helium, water vapor, dry air, carbon monoxide, carbon dioxide or a mixture of two or more thereof The apparatus for continuously casting thin cast strip claimed may have in addition a control system that comprises:

hydraulic motors capable of controlling the contact the casting surface of each casting roll in advance of contact of the casting surfaces with the molten metal in the casting area; and a monitoring device capable of monitoring the torque of the hydraulic motors to control the energy exerted by the rotating brushes against the casting surfaces of the casting rolls using the desired degree of cleaning as a reference to clean the expose a majority of projections of the casting surfaces of the casting rolls and provide wetting contact between the casting surface and the molten metal of the casting area.

The monitoring device may be capable of monitoring the torque of the hydraulic motors by measuring the pressure differential between inlet and outlet of hydraulic fluid through the hydraulic motors. Alternatively, the monitoring device may be capable of measuring the torque between the hydraulic motor and a chock or a motor mount.

BRIEF DESCRIPTION OF THE DRAWINGS

In order that the invention may be more fully explained, particular embodiments will be described in detail with reference to the accompanying drawings in which.

DETAILED DESCRIPTION OF THE DRAWINGS

Figure 1:
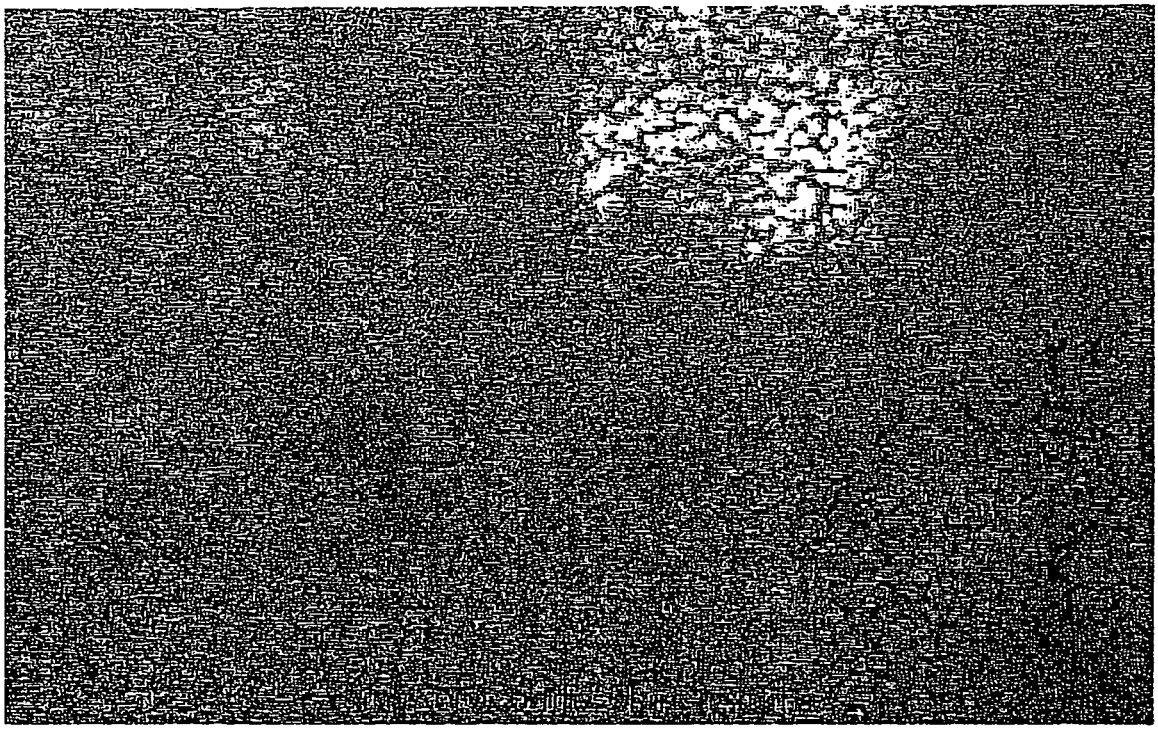
FIG. 1 is a micrograph showing crocodile skin surface roughness controlled by the present invention.

The embodiments are described with reference to a twin roll caster in FIGS. 4 through 8. The illustrated twin roll caster comprises a main machine frame 11 which supports a pair of parallel casting rolls 12 of generally textured outer peripheral casting surfaces 12A. Molten metal of plain carbon steel of less than 0.065% by weight carbon is supplied during a casting operation from a ladle 13 through a refractory ladle outlet shroud 14 to a tundish 15, and from there, through a metal delivery nozzle 16 (also called a core nozzle) between the casting rolls 12 above the nip 17. Hot metal thus delivered forms a molten metal casting pool 10 above the nip supported on the casting surfaces 12A. This pool is confined at the ends of the rolls by a pair of side closure or side dam plates 18 which may be held against stepped ends of the casting rolls by actuation of a pair of hydraulic cylinder units (not shown). The upper surface of the pool 10 (generally referred to as the "meniscus" level) may rise above the lower end of the delivery nozzle 16 so that the lower end of the delivery nozzle is immersed within the pool.

Casting rolls 12 are water cooled so that shells solidify on the casting surfaces 12A as the casting surfaces move in contact with the casting pool 10. The casting surfaces may textured, for example, with a random distribution of discrete projections as described and claimed in application Ser. No. 10/077,391, filed Feb. 15, 2002 and published Sep. 12, 2002, as US 2002-0124990. The shells are brought together at the nip 17 between the casting rolls to produce a solidified thin cast strip product 19 at the nip. This thin cast product may be fed, typically with further processing, to a standard coiler (not shown).

The illustrated twin roll caster as thus far described is of the kind which is illustrated and described in some detail in our Australian Patent 631728 and our U.S. Pat. No. 5,184,668 and reference may be made to those patents for appropriate constructional details which form no part of the present invention.

A pair of roll brushes denoted generally as 21 is disposed adjacent the pair of casting rolls such that they may be brought into contact with the casting surfaces 12A of the casting rolls 12 at opposite sides of nip 17 prior to the casting surfaces of the casting rolls prior coming into contact with the molten metal casting pool 10.

Each brush apparatus 21 comprises a brush frame 20 which carries a main cleaning brush 22, for cleaning the casting surfaces 12A of the casting rolls 12 during the casting campaign, and optionally, a separate sweeper brush 23 cleaning the casting surfaces 12A of the casting rolls 12 at the beginning and end of the casting campaign. The main cleaning brush may be segmented if desired, but is generally one brush extended across the casting roll surface 12A of each casting roll 12. Frame 20 may comprise a base plate 41 and upstanding side plates 42 on which the main cleaning brush 22 is mounted. Base plate 41 may be fitted with slides 43 which are slidable along a track member 44 to allow the frame 20 to be moved toward and away from one of the casting rolls 12, and thereby move the main brush 22 mounted on the frame 20 by operation of the main brush actuator 28. A sweeper brush 23, if present, may be mounted on frame 20 to move independently of the main brush 22 by operation of sweeper brush actuator 28A from retracted positions to operative positions in contact with the casting surfaces 12A of the casting rolls 12, so that either the sweeper brush 23 or the main brush 22, or both, may be brushing the casting surfaces of the casting rolls without interruption in the brushing operation between them.

What is important is that the energy exerted by the cleaning brush 22 against the casting surfaces 12A of the casting rolls 12 is controlled so that the cleaning of the casting roll surfaces is maintained at a specified level during the casting campaign, and in turn formation of crocodile skin roughness on the thin cast strip is controlled. The energy exerted by the brush on the casting surface 12A is controlled by controlling the pressure of the brush on the casting rolls, or the rotational speed of the cleaning brush 22, or both, based on measurement of the heat flux from the molten metal in the casting pool 10 to the casting surfaces 12A of the casting rolls 12. This pressure and rotational speed will be varied according to the casting speed during the casting campaign. This control may be done manually or automatically as described in the invention.

The method may be practiced by controlling the energy exerted by the rotating brush to maintain the casting surfaces 12A of the casting rolls 12 clean, as above described, during the casting campaign. This may be done by cleaning to expose a majority of the projections of the casting surfaces of the casting rolls 12, and measuring this initial heat flux between the molten metal and the casting rolls. The heat flux is then continually measured in real time either continuously or intermittently during the casting campaign, and then the difference between the real time heat flux and the initial heat flux measured, to control the energy exerted by the cleaning brush 22 on the casting roll surfaces 12A of the casting rolls 12. The heat flux, both initially and in real time, can be measured by measuring the difference in temperature of the cooling water circulated through the casting rolls between the inlet and outlet as described in U.S. Pat. Nos. 6,588,493 and 6,755,234. Although this is the best way presently contemplated for measuring the heat, the heat flux can be measured by any available method.

The initial measured heat flux is related to the desired degree of cleaning of the casting roll surfaces 12A, as above described, to control the formation of crocodile skin roughness during the casting campaign. The continual measured heat flux in real time, and the difference between the initial heat flux and the real time heat flux measured, is used to control the energy exerted by the cleaning brush on the casting surfaces 12A so that cleaning of the casting roll surfaces 12A is controlled, and in turn, the formation of crocodile skin roughness on the surface of the cast strip controlled.

The method can thus be automated by providing a control system (not shown) responsive to sensors monitoring the heat flux, calculating the difference in heat flux from the initial heat flux measured, and controlling the energy exerted by the brush against the casting surface based in the difference in heat flux from the initially heat flux measured. The cleaning brush 22, the main cleaning brush, may be in the form of a cylindrical barrel brush having a central body 45 carried on a shaft 34 and fitted with a cylindrical canopy of wire bristles 46. Shaft 34 may be rotatably mounted in bearings 47 in the side plates 42 of frame 20, and a hydraulic, pneumatic, or electric drive motor may be mounted on one of these side plates coupled to the brush shaft 34 so as to rotatably drive the cleaning brush 22 in the opposite direction of the rotation of the casting surfaces 12A of casting roll 12. Although the main brush 22 is shown as a cylindrical barrel brush, it should be understood that this brush may take other forms such as the elongate rectangular brush disclosed in U.S. Pat. No. 5,307,861, the rotary brushing devices disclosed in U.S. Pat. No. 5,575,327 or the pivoting brushes of Australian Patent Application PO7602. The precise form of the main brush is not important to the present invention. What is important is that the energy exerted by the cleaning brush against the casting surfaces capable of being controlled so the cleaning of exposed casting surface of the casting rolls is controlled throughout the casting campaign and, in turn, formation of crocodile skin surface roughness of the cast strip is controlled. The energy exerted by cleaning brush 22 against the casting surface 12A of the casting roll 12 may be controlled by controlling the application pressure or the speed of rotation, or both, of an electric, pneumatic or hydraulic motor rotating the brush coordinated with the casting speed.

The energy, pressure or rotation speed of the rotating brush can be measured by measuring the torque of the motor rotating. The rotational speed of the cleaning brush 22 can be measured, for example, by a flow meter measuring the flow of hydraulic fluid through a hydraulic motor driving the rotating cleaning brush 22. The torque of the motor may be monitored by measuring the pressure differential between inlet and outlet of hydraulic fluid through a hydraulic motor. Alternatively, the torque of the motor may be monitored by measuring the torque with a strain gauge, load cell or other device between the motor and mount for bearings 47 (i.e., chock) or other convenient part of the motor mount structure.

Figure 2:
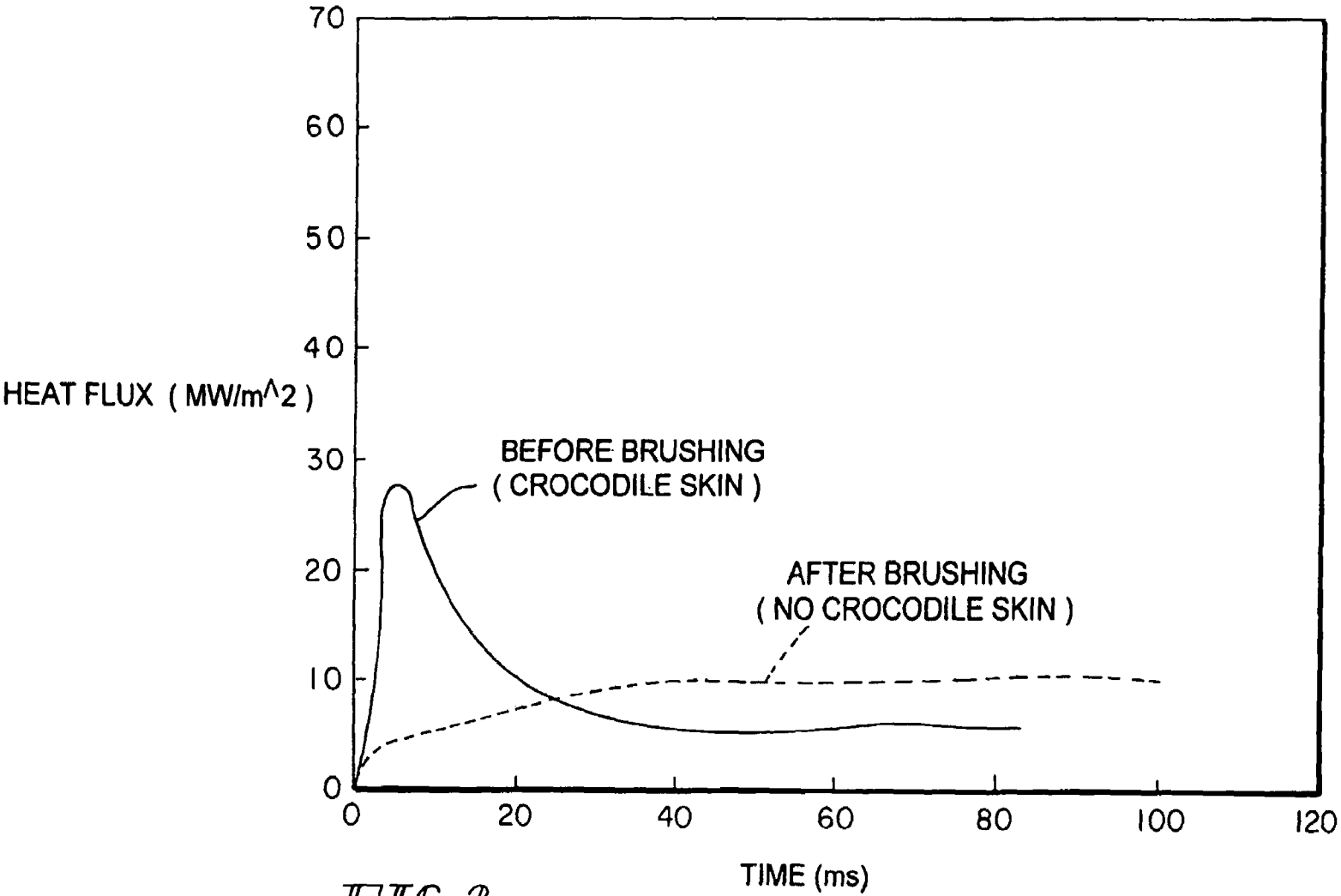
FIG. 2 is a graph illustrating the relationship between controlling localized heat flux and controlling the formation of crocodile skin surface roughness.
Figure 3:
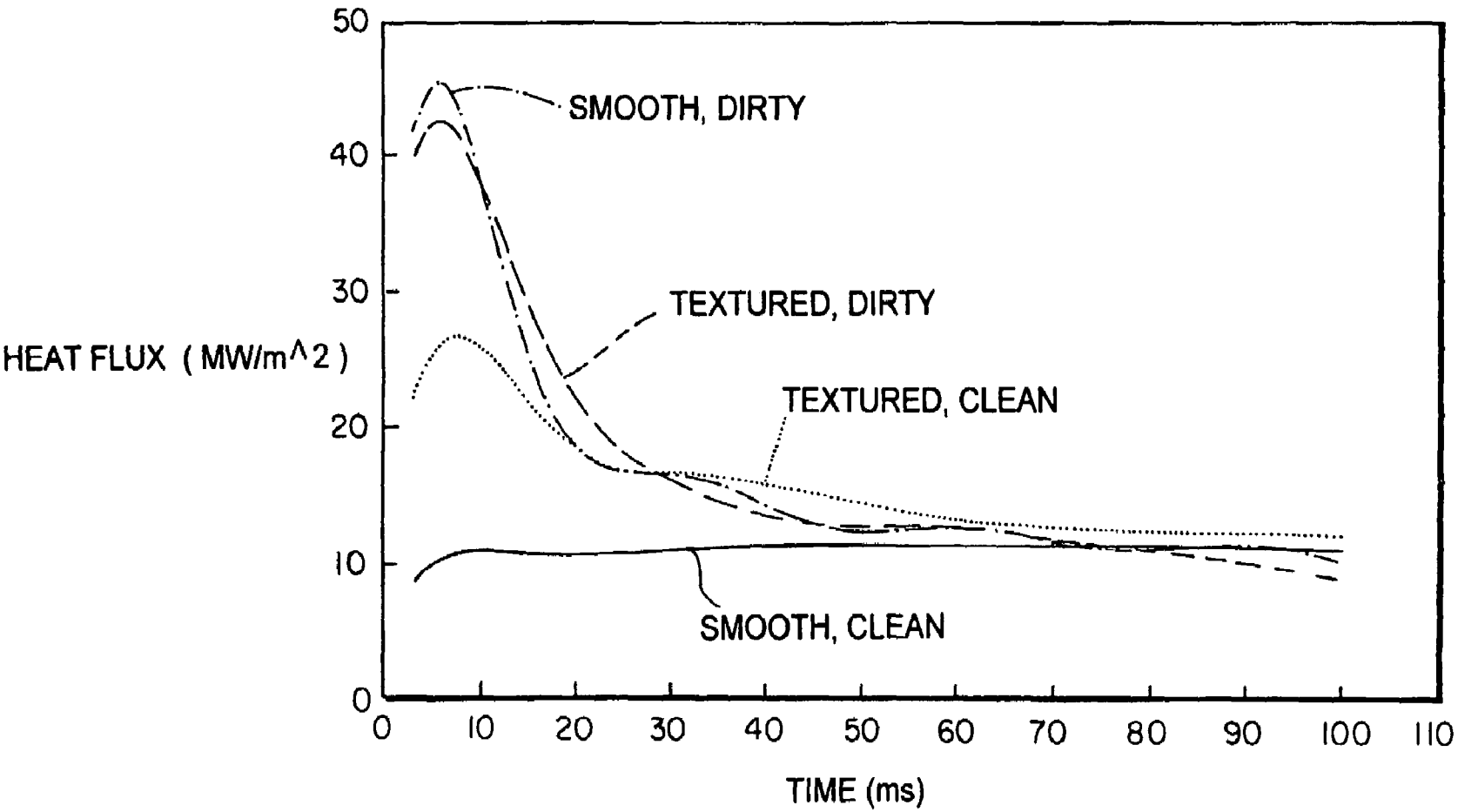
FIG. 3 is a graph illustrating the relationship between controlling localized heat flux and controlling the formation of crocodile skin surface roughness with smooth and textured casting roll surfaces.

Although the main cleaning brush 22 may be driven in a direction counter to the rotation of the casting roll, the main brush 22 is usually driven in the same rotational direction as the casting rolls, as indicated by the arrow 36 in FIG. 2. Note means that the casting surface 12A is moving in a direction opposite to the movement of the bristles of the brush 22 against the casting surface of the casting roll.

If used, the separate sweeper brush 23, which is peripherally involved in use of the best mode of the invention contemplated, may be in a form of a cylindrical barrel brush which is mounted on frame 20 so as to be moveable on the frame such that it can be brought into engagement with the casting surfaces 12A of casting roll 12, or retracted away from that the casting surface by operation of the sweeper brush actuator 28A independent of whether the main brush is engaged with the casting surfaces of casting roll. This enables the sweeper brush 23 to be moved independently of the main brush 22 and brought into operation only during the start and finish of a casting run and be withdrawn during normal casting as described below. The sweeper brush 23 may be rotatably driven in tandem with or independently of the main brush 22. The sweeper brush 23 may also be driven in the same direction as the casting surfaces 12A of casting rolls 12 at a speed different from the speed of the casting rolls 12. In this way, the large accretions that can occur at the start and end of the casting run are less likely to be dragged across the casting surfaces 12A and cause scoring of the casting surface 12A, where the sweeper brush 23 is contacting the casting surfaces 12A moving in the direction counter to movement of the casting surface.

If used, sweeper brush 23 may have a central body 24 carried on a shaft 25 and fitted with a cylindrical canopy of wire bristles 26. The brush shaft 25 may be rotatably mounted in a brush mounting structure 27 which can be moved back and forth by operation of quick acting hydraulic cylinders 28 to move the brush 23 inwardly against the casting roll 12 or to retract it away from the casting roll. The roll mounting structure 27 may be in the form of a wide yoke with side wings 30 in which the brush shaft 25 is rotatably mounted in bearings 31. The brush 23, brush mounting structure 27 and actuator 28 may be carried on the main frame 20 of the brushing apparatus 21 so that the sweeper brush 23 will always be correctly positioned in advance of the cleaning main brush 22. The roll mounting structure 27 may also carry an elongate scraper blade 29 which extends throughout the width of the barrel brush 23 and projects into the canopy of bristles 26. Blade 29 may be made of hardened steel and have a sharp leading edge.

Figure 4:
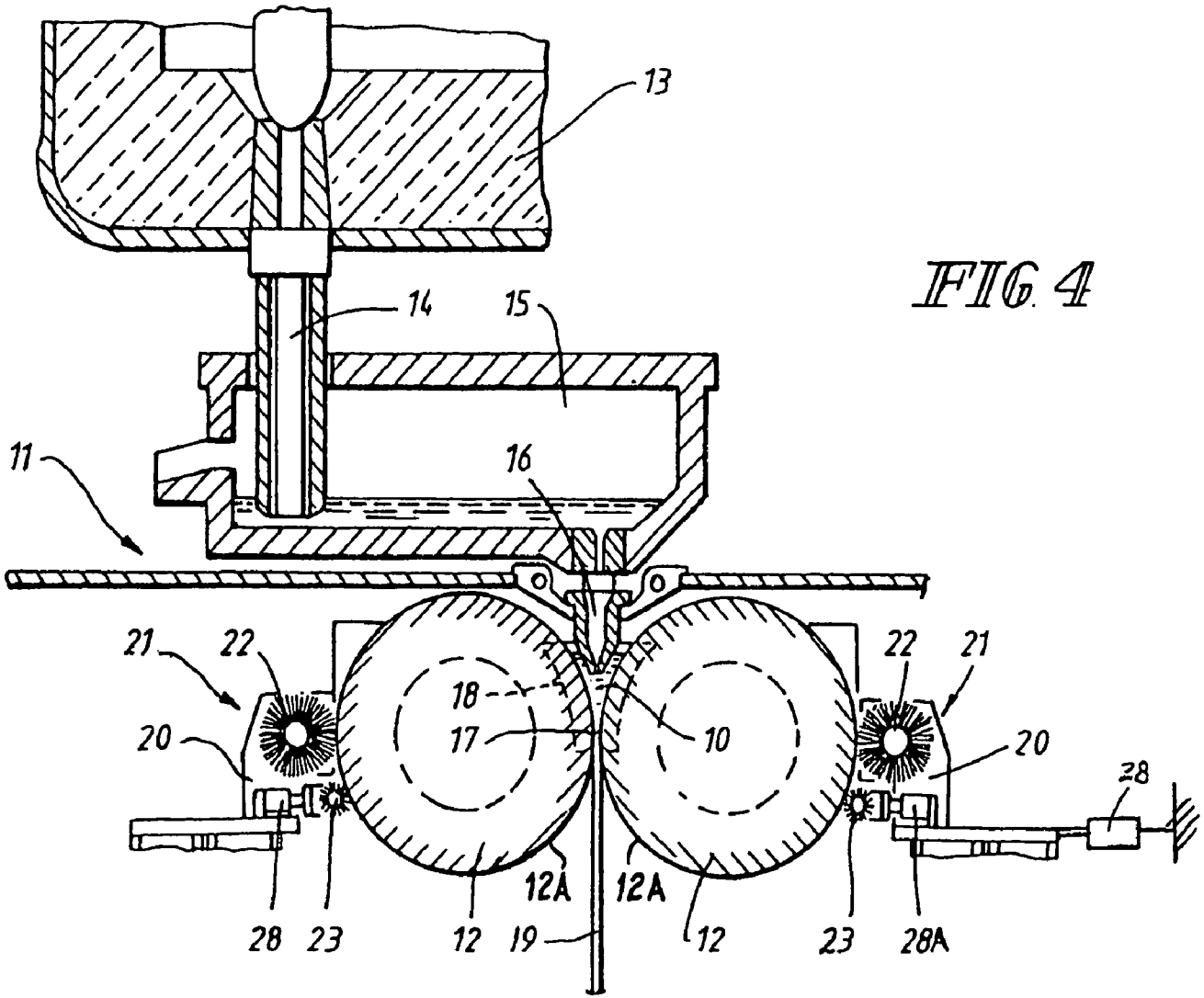
FIG. 4 illustrates a twin roll caster incorporating a pair of brushing apparatus in accordance with the invention.
Figure 8:
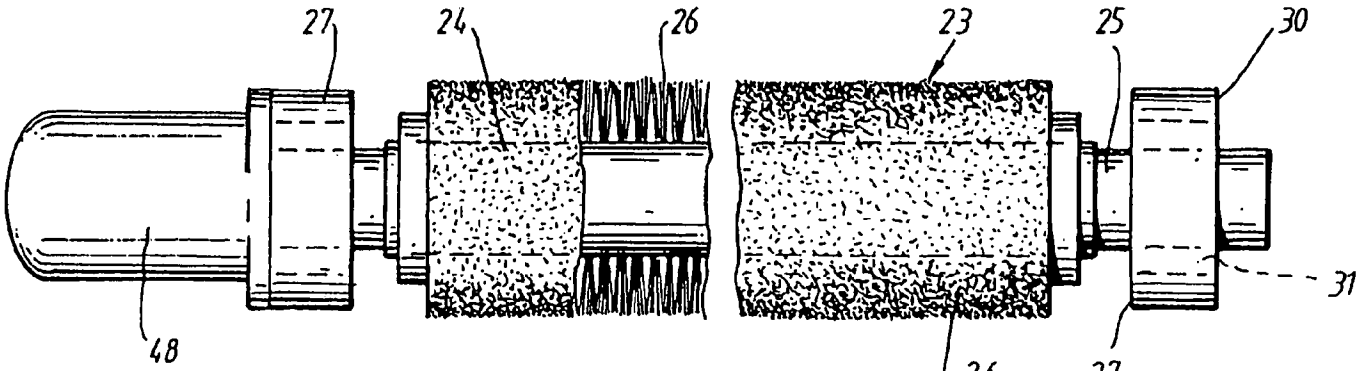
FIG. 8 is a front elevation of the sweeper brush in a modified apparatus in which the sweeper brush is positively driven by a drive motor.

Sweeper brush 23 may be rotated purely by frictional engagement between its canopy of bristles 26 with the casting roll 12, in which case it may be simply rotatably mounted between the side plates 42 of frame 20 without any drive to drive rotation as shown in FIG. 4. However, typically, the sweeper brush 23, if used, is positively driven by provision of a pneumatic, electric or hydraulic drive motor 48 as shown in FIG. 8.

Figure 5:
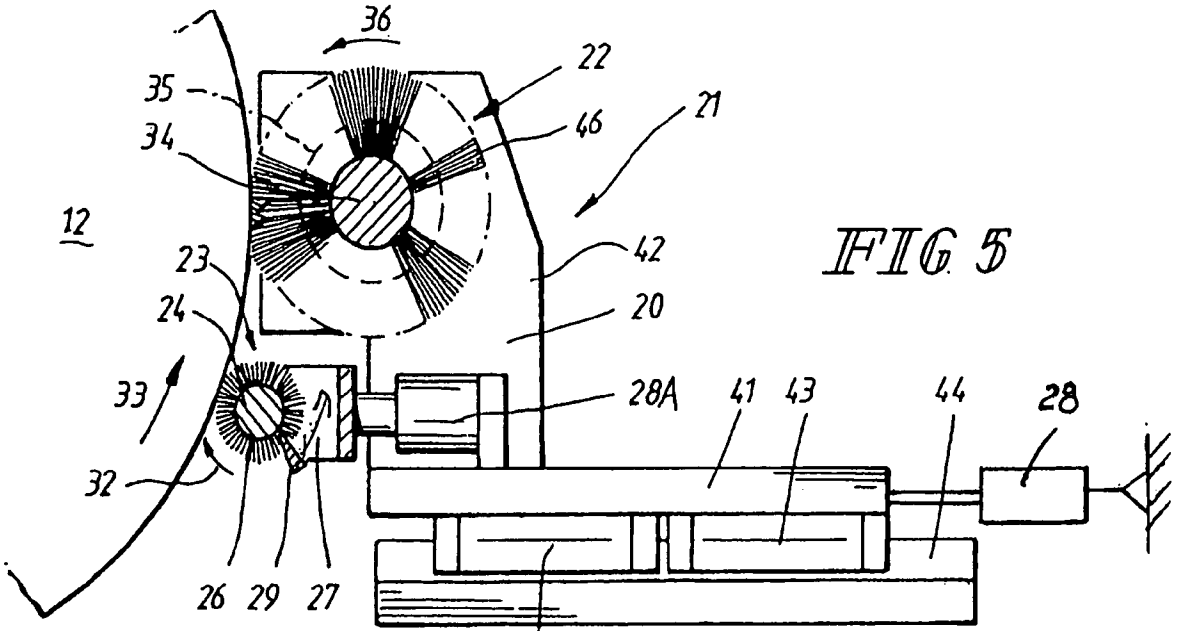
FIG. 5 illustrates one of the brushing apparatus.
Figure 7:
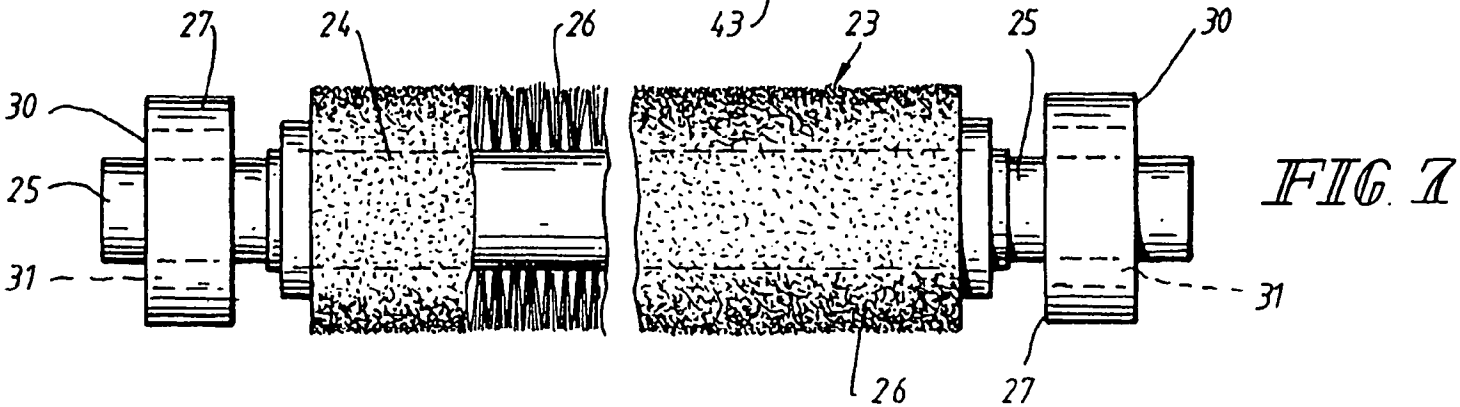
FIG. 7 is a front elevation of a sweeper brush of the brushing apparatus.
Figure 6:
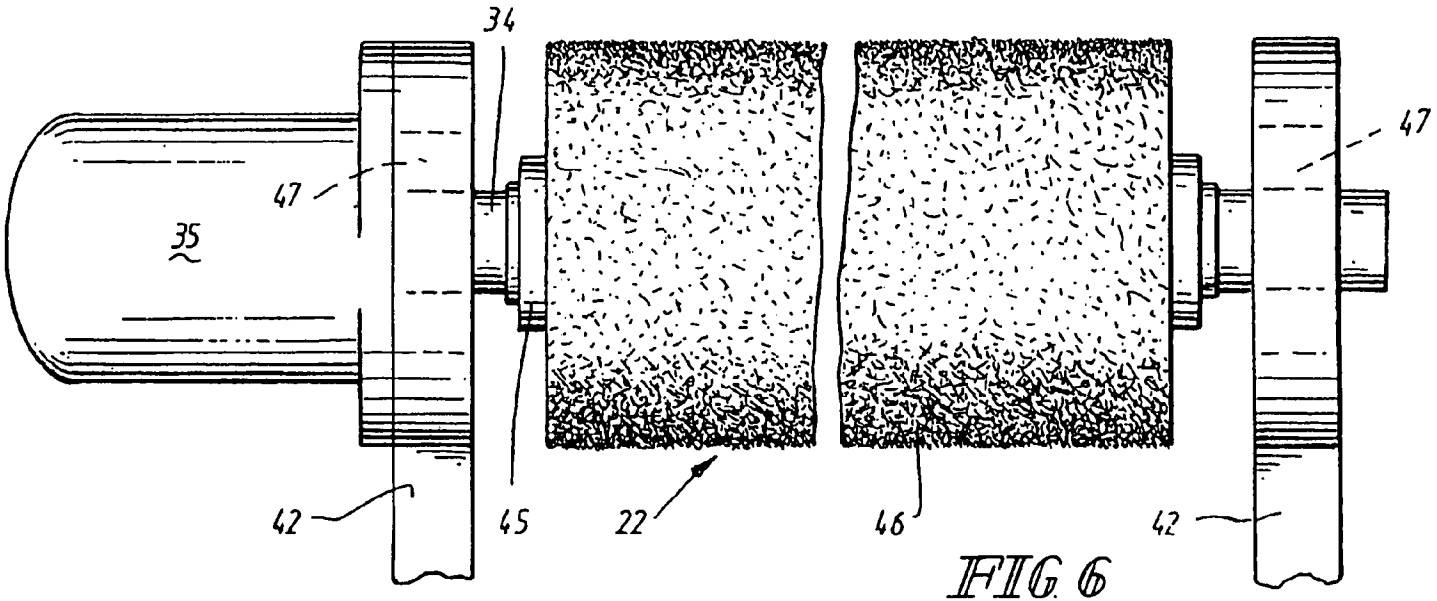
FIG. 6 is a front elevation of a main brush of the brushing apparatus.

With the arrangement shown in FIG. 4, sweeper brush 23 is biased inwardly against the casting roll 12 by actuation of the cylinder units 28 such that it is rotatably driven by the frictional engagement between the canopy of bristles 26 and the roll surface so that it is rotated in the opposite rotational (same peripheral) direction at the casting surface 12A at the region of its engagement with the casting surface, as indicated by the arrows 32, 33 in FIG. 5. The rotation of the sweeper brush 23 may be retarded by its inter-engagement with the scraper blade 29 so that the sweeper brush 23 is driven at a slower peripheral speed than casting roll 12. The relative speed between the roll and the barrel brush 23 may cause effective sweeping action and ensure that the bristles engaging the casting roll will change continuously. The scraper blade 29 also effectively cleans the sweeper brush 23 of contaminating material swept from the casting surface 12A of the casting roll 12 so that clean bristles are continuously presented to the casting roll 12 surface. A sweeper brush drive motor 48 may be provided as shown in FIG. 8, so that sweeper brush 23 can be positively driven at a fixed speed independent of the speed of the casting roll 12. It will generally be driven so that its bristles travel in the same rotational direction as the surface of the roll 12 but at a different (higher or lower) speed. The rotational speed of the sweeper brush 23 can be varied to optimize this speed differential.

Sweeper brush 23 is moved into contact with the casting surfaces 12A of the casting roll 12 prior to the start of casting and is moved away from the casting surfaces after casting conditions have stabilized. It is moved back into engagement with the casting surfaces just prior to termination of the cast. The point at which the casting conditions stabilize, and sweeper brush 23 disengaged from the casting surfaces, is usually about when the set point is reached for the level of the pool 10 of molten metal, and the point at which the sweeper brush 23 reengage is usually about when the set point level of the pool 10 is about to drop as the end of the casting run approaches. The sweeper brush 23 serves to prevent damage to the main brush 22 and the casting surface 12A of casting roll 12 due to carry over of debris generated on commencement and near termination of the casting run.

If clean bands are to be used in practicing the present method, before the casting campaign, each of casting rolls 12 are prepared with a clean band (not shown) before casting preferably at each end of the casting roll. This may be done by providing a chalk mark or soap stone mark on the casting surface 12A of the casting roll by rotating the casting rolls to make the mark along the circumferential surface. This chalk or soap stone mark may be positioned at each end of the casting roll 12 to ensure that the cold machine roll crown is not affected by creation of clean bands on the casting roll. Preferably a clean band is positioned about 8 inches from each end of the casting roll and each band is about 15 millimeters in width. After the chalk or soap stone marks are formed on the casting roll surfaces, the cleaning brush 22 are applied to the casting surface 12A of the casting roll as it is rotated to create the clean bands. The clean bands are characterized by a large central "clean area" with a feathered appearance toward the outside where the brush contact with the casting roll surfaces becomes reduced. A clean band is the clean area formed by the contact of the brush 22 with the casting surface 12A, not including the feathered portions. During the subsequent casting campaign, the clean band(s) provide the reference for the energy to be exerted by the main brush 22 against the casting roll surfaces 12 to keep the casting roll surfaces clean in accordance with the present invention. This alternative is particularly used where the energy of the rotating brush exerted against the casting rolls during the casting campaign is controlled by an operator observing the casting surfaces of the casting rolls.

Figure 9:
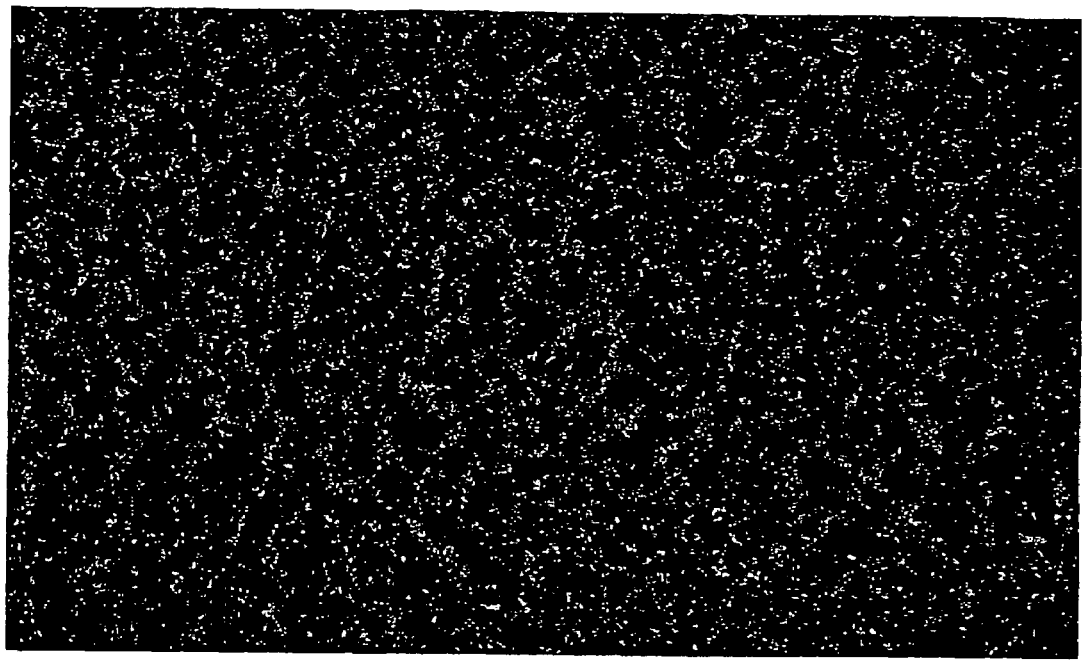
FIGS. 9 through 11 are micrographs showing textured casting roll surfaces cleaned in accordance with the present invention with the projections of the casting roll showing.
Figure 10:
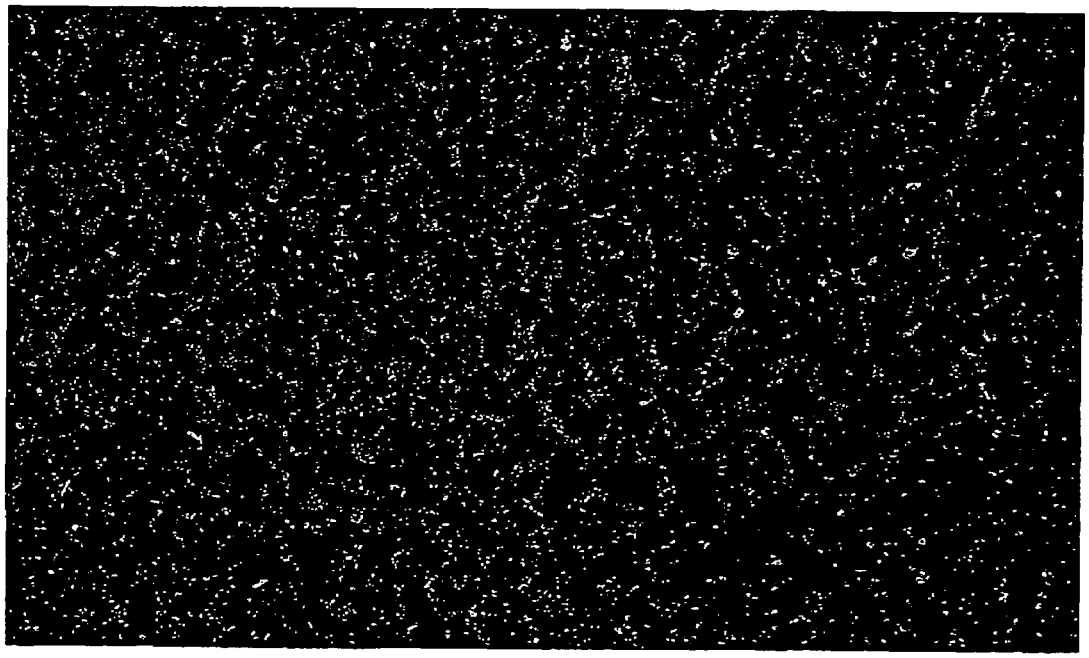
Figure 11:
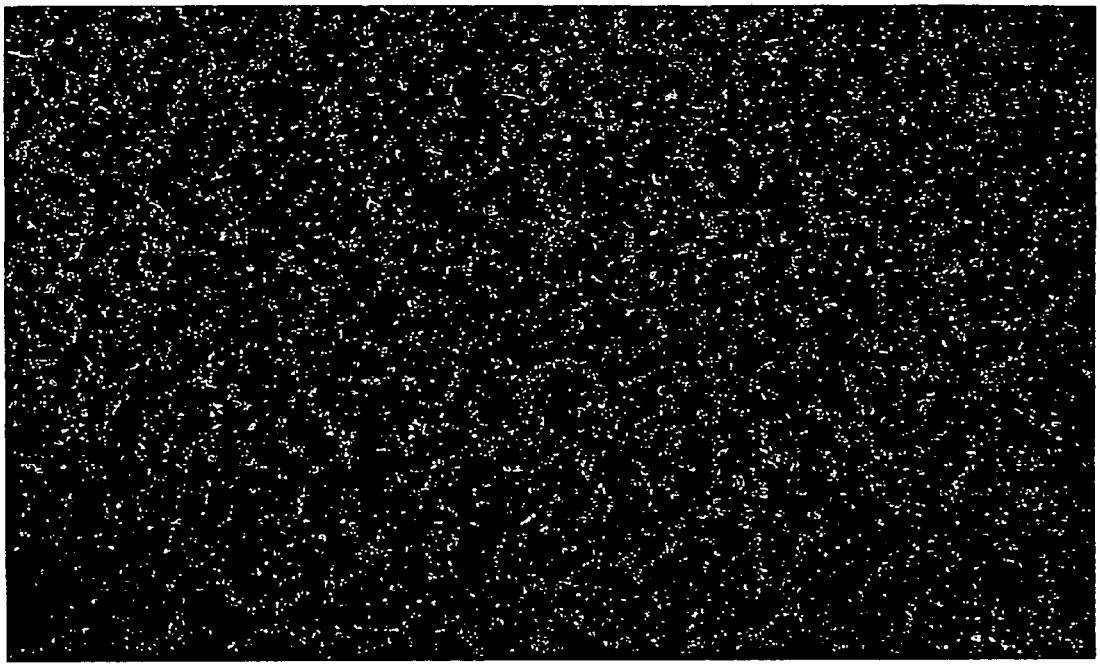

To illustrate the cleaning done in accordance with the present invention, micrographs of textured casting roll surfaces 12A are shown in FIGS. 9 through 11. As shown, the casting roll surfaces are not pristine clean. There is residuals in the low areas and entices in the casting surface, and not even all exposed projections of the casting roll surface are effectively clean. However, a substantial number of the projections are visible with exposed surfaces as shown, and are cleaned sufficiently that the formation of crocodile skin roughness is inhibited if or eliminated during casting. By rotating brushes cleaning the casting roll surfaces as shown in FIGS. 9-11, the casting roll surfaces 12A can be wetted by the molten metal in the casting pool 10, and heat flux can be effectively transmitted from the molten metal to the casting rolls when the casting surfaces are in contact with the casting pool while crocodile skin roughness is inhibited.

Figure 12:
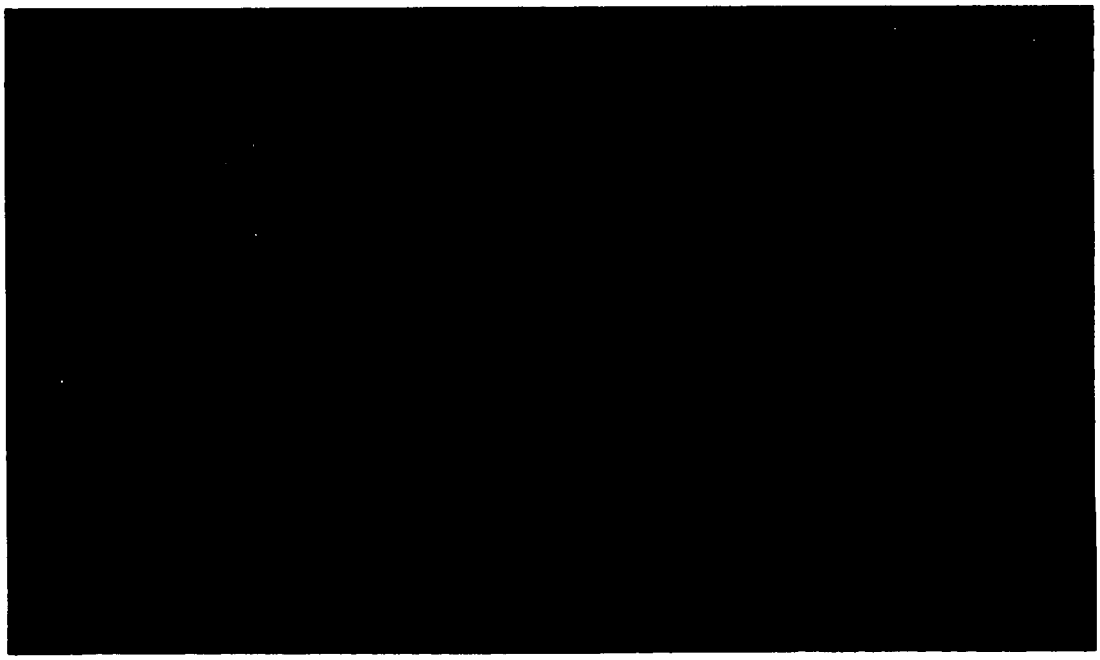
FIGS. 12 and 13 are photomicrographs of textured casting roll surfaces which were not properly cleaned in accordance with the present invention for purposes of illustration.
Figure 13:
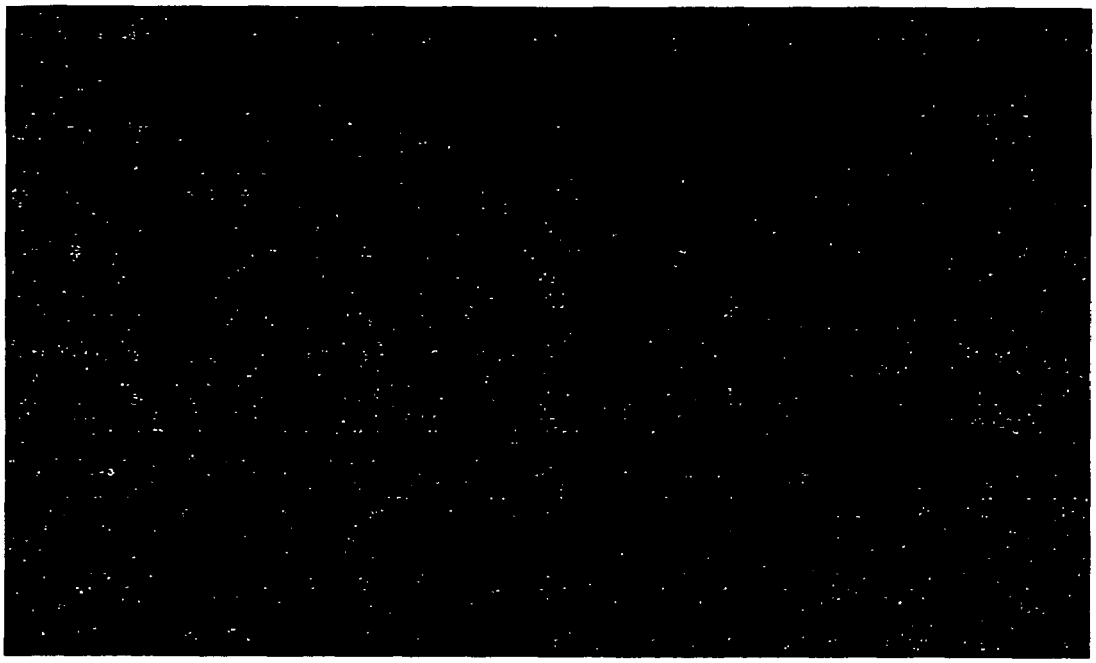

FIGS. 12 and 13 are provided for purposes of comparison. FIGS. 12 and 13 show where the projections of the textured casting roll surface 12A are "buried" beneath the molten melt and the casting surfaces is not exposed so that is effective heat flux from the molten metal to the casting roll surfaces in accordance with the present invention.

Figure 14:
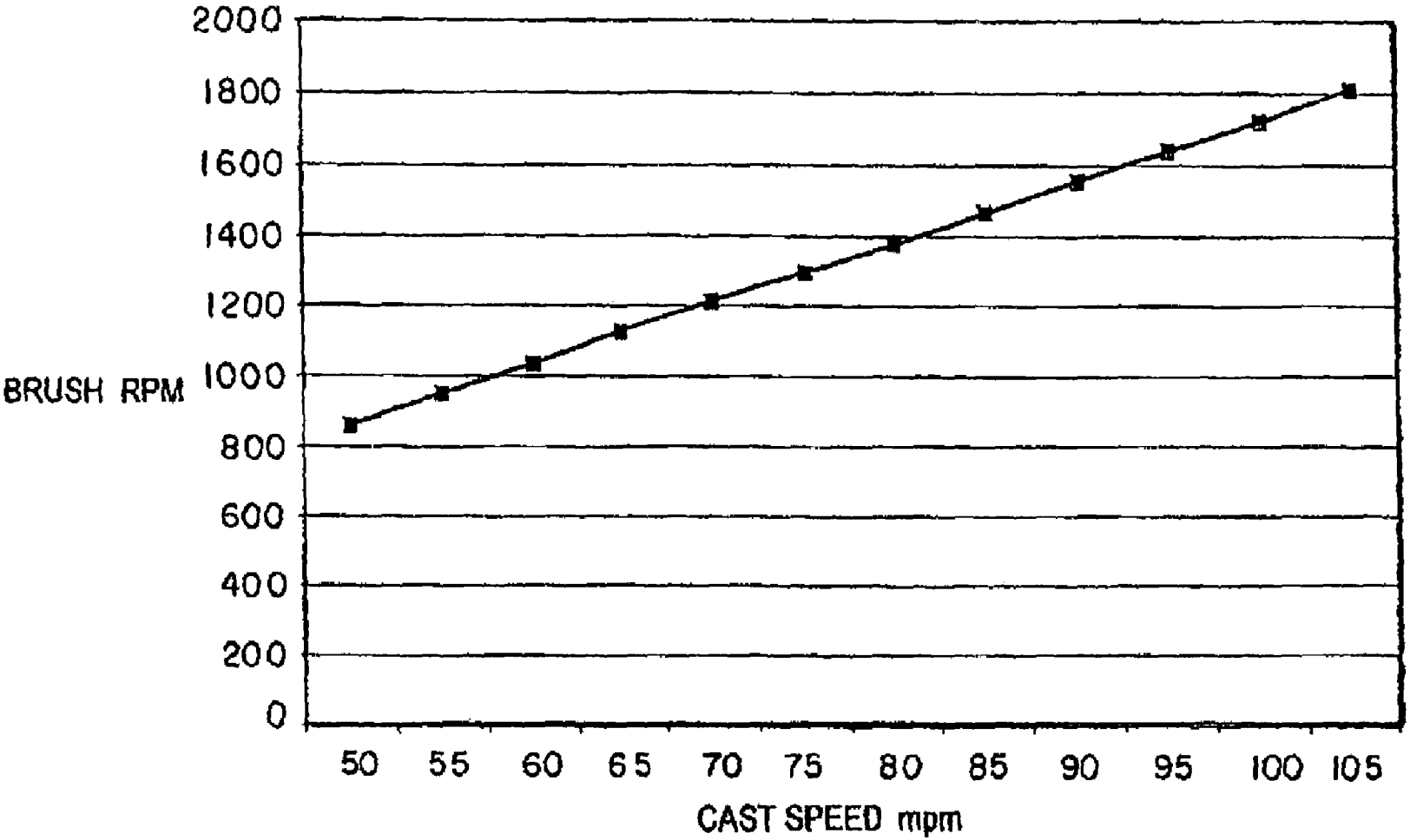
FIG. 14 is a graph showing the relationship between rotational speed of the sweeper brush and the casting speed of the caster.

We have also found that the cleaning efficiency requires maintaining a relationship between the rotational speed of the cleaning brush of the sweeper brush and the casting speed with the caster. FIG. 14 is a graph showing the relationship for a particular embodiment of the invention that has been built. Similar relationships can be empirically derived for other embodiments of the invention. This relationship provides for control of the energy of the brushes exerted against the casting surfaces to be maintained during the casting campaign.

Figure 17:
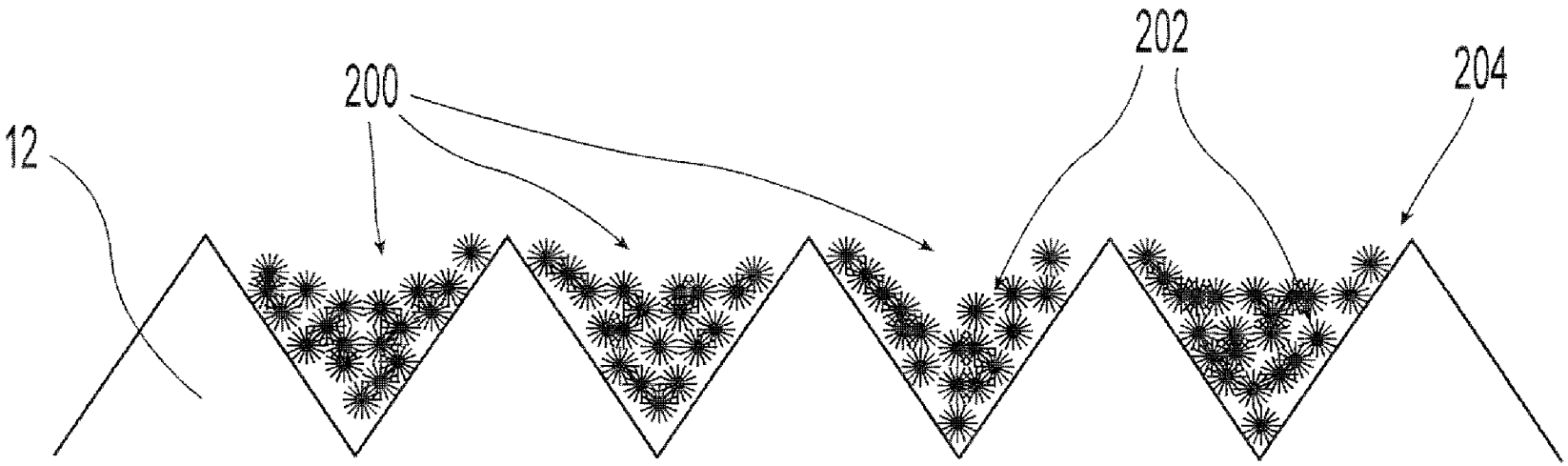
FIG. 17 is a schematic representation of a portion of the casting surface of a casting roll.

FIG. 17 is a schematic illustration of a part of the casting surface 12A of a casting roll 12 just after the rotating brush 22 has removed oxides and contaminants from the casting surfaces 12A. Shown schematically, the texture of the casting surface of the casting roll has projections 204, and shows the majority of the projections 204 can be exposed while the majority of the area of the casting surface 12A remains "buried" with oxides. During the casting operation, the oxides and other contaminants 202 form on the casting roll surfaces 12A. The rotating brush 22 removes some of these oxides 202 to expose the projections 204 of the casting surface 12A while leaving the areas 200 covered with oxides. It has been found that delivering a boundary layer gas over the casting surface as illustrated in FIG. 17 improves the control of the heat flux during the casting campaign.

Figure 15:
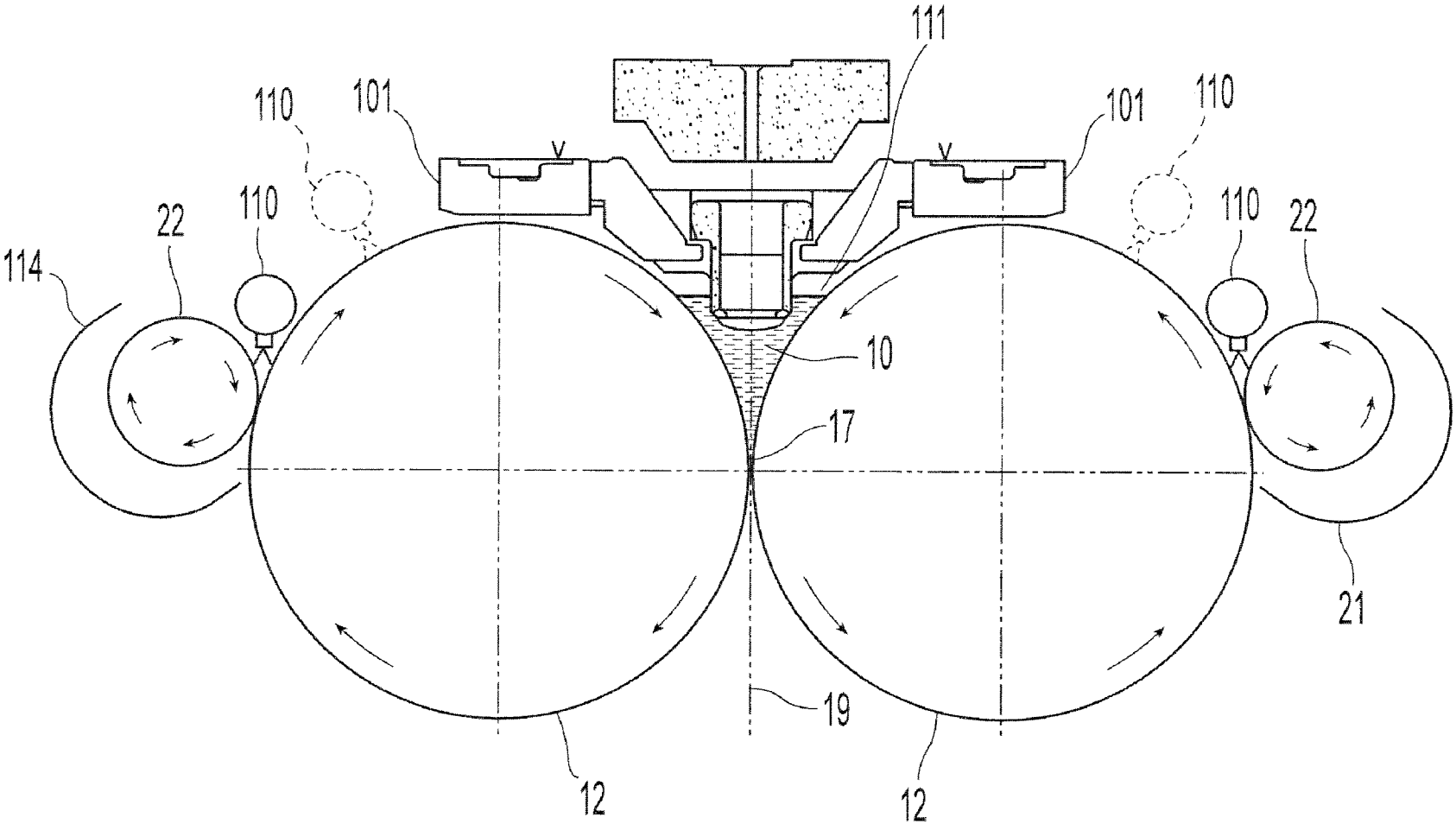
FIG. 15 illustrates a twin roll caster incorporating a pair of brushing apparatus and a gas injector in accordance with the invention.
Figure 16:
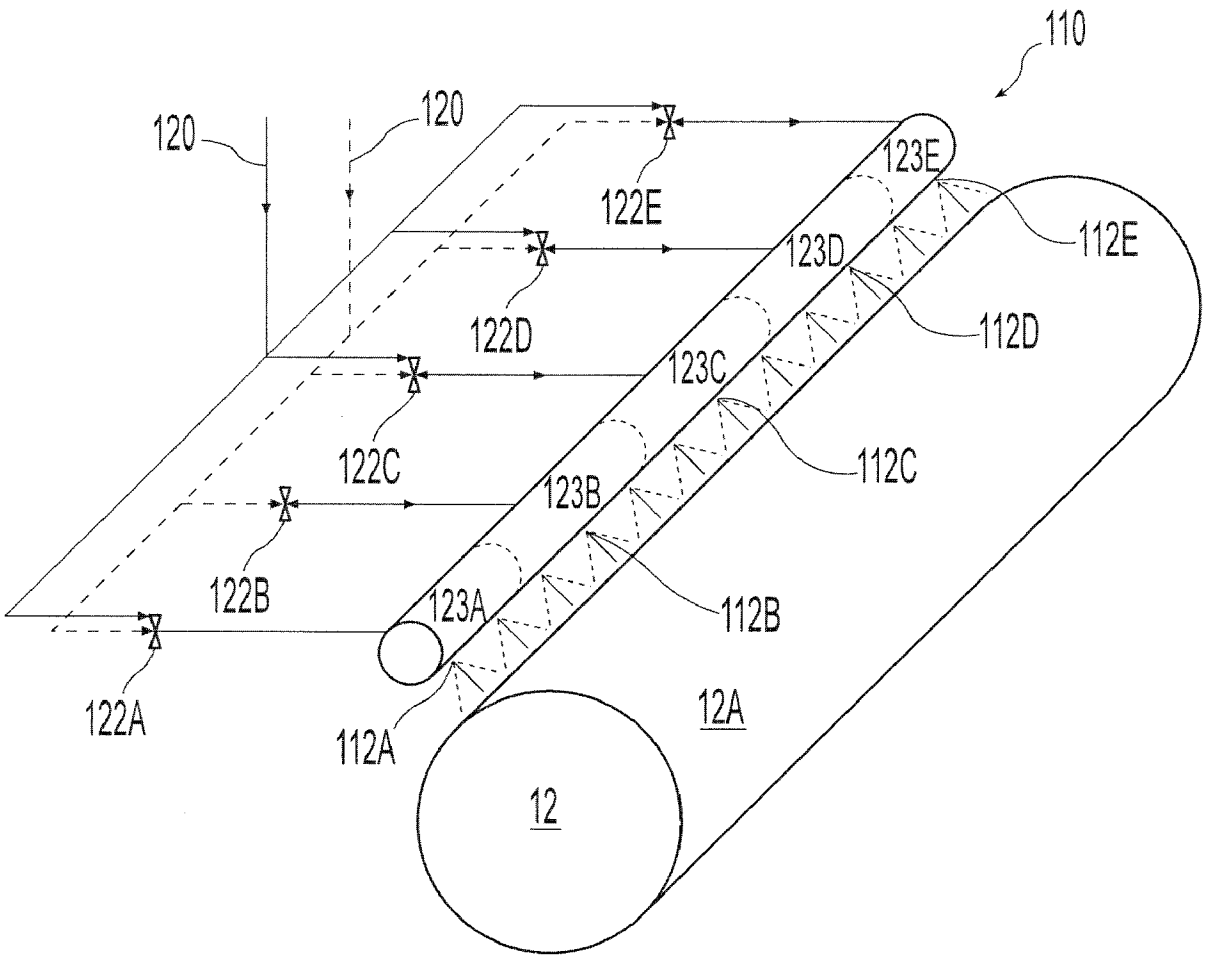
FIG. 16 illustrates one embodiment of the gas injector shown in FIG. 15.

Turning to FIGS. 15 and 16, the method and apparatus for delivering gas at the casting surface of the casting rolls 12 and forming a boundary layer of gas on the casting surfaces of the casting rolls 12 where oxides have been removed by rotating brushes. The gas 120 is conveyed from gas sources to a gas header 110 through a plurality of valves 122A, 122B, 122C, 122D and 122E. In one embodiment, the gas 120 flows from the gas source, not shown, through the gas valves and into a purge or distribution header 110. The gas header 110 may be provided in a series of five zones 123A, 123B, 123C, 123D and 123E extending along the casting surface 12A of each casting roll 12. The gas header 110 may be connected internally within the header or maintained as separate compartments. From the header 110, the gas flows through a plurality of nozzles 112A-112E positioned along the casting surface 12A of a casting roll 12, from where the gas is directed on the casting surface of the casting roll. The gas flows into the spaces 200 from which the rotating brushes 22 have just removed oxides 202 as shown in FIG. 17. One purpose of the forming a boundary gas layer is to prevent other contaminants, such as the casting room atmosphere, moisture, dust, etc. from being deposited on the just cleaned casting roll surface 12A.

In any case, the gas delivered in the respective zones may be different and varied in composition, mixture, pressure, or at least two thereof, by delivering of the gas on the casting surface by manual or automated control of the valves 122A, 122B, 122C, 122D and 122E. The plurality of gas valves are provided to control the delivery rate of the gas on the casting surface 12A of the casting rolls 12, and to control the mixing ratio when more than one gas is being delivered. The valves 122A, 122B, 122C, 122D and 122E may be either manually controlled or automatically controlled with a computer system (not shown). This embodiment is particularly of utility, for example, in providing a different gas mixture, pressure or composition adjacent the ends of the casting rolls because of the difference in heat gradient adjacent the ends of the casting rolls, compared to the central area of casting surface 12A of the casting roll 12. In addition, the composition, mixture, or pressure of the gas delivered through valves 122A, 122B, 122C, 122D and 122E to one or more of the zones along the casting surface 12A of the casting roll 12 may be varied in similar manner during the casting campaign to enable the heat flux from the molten melt to the casting rolls to be controlled for desired results.

In any case, one or more gases selected from the group consisting of nitrogen, argon, helium, hydrogen, water vapor, carbon monoxide, carbon dioxide, dry air, or mixtures thereof, may be used for these purposes The gas header 110 may be provided to deliver gas in the nip between the brush 22 and the casting surface 12A of the casting roll 12 as shown in FIG. 15 to simultaneously deliver the gas to the casing surface as the oxides are removed, or positioned adjacent the brush 22 along the casting surface of the casting roll as shown in ghosting on FIG. 15. If desired, the gas may be delivered through the housing 21 around the brush 22 designed to capture the oxides removed by the brush and convey them away in a suitable capture and disposal system (not shown). The positioning of the gas header shall, in any case, be between the brush 22 and the entry into the casting area 111 at the twelve o'clock position under the gas curtain seals 101 position It is expected that the closer the gas header 110 delivers the gas to where the oxides are removed by the rotating brush the more effective is the present method and apparatus for control of the heat flux.

It should be noted that five zones are illustrated in FIG. 16, but as few as three zones may be provided for this purpose or any number greater than three zones may be provided for segmented control of the gas delivery to the casting surface of a casting roll. Also, more than one gas header 110 may be provided in parallel along the casting surface of the casting roll to provide for delivery of the gas to the casting surface of the casting roll. Also, the step of delivering on the casting surface of each casting roll to replace the removed oxides may comprise flooding the casting surfaces adjacent the rotating brushes with a gas.

Figure 18:
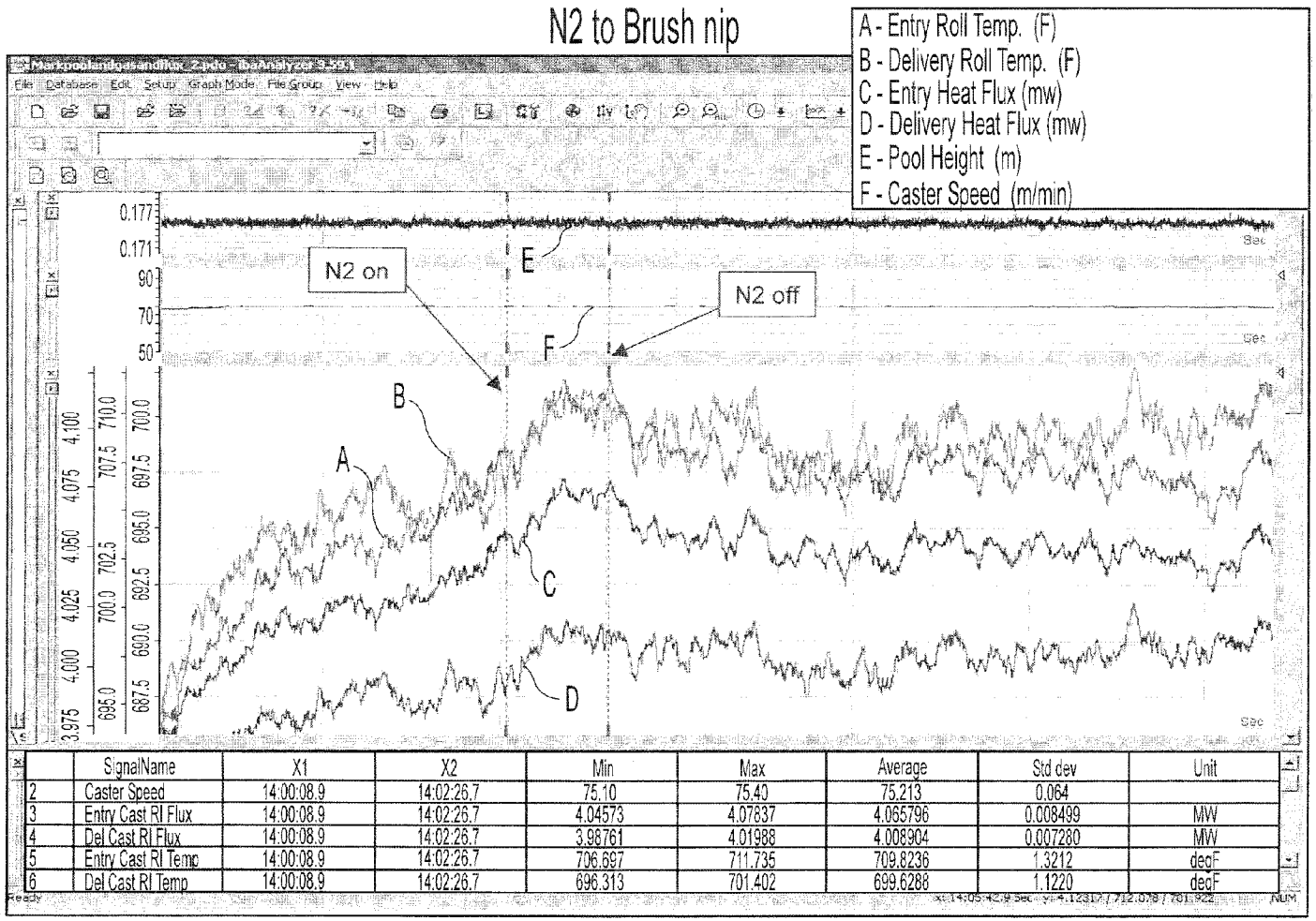
FIG. 18 shows the effect on heat flux when gas flooding with nitrogen is commenced and terminated.

Referring to FIG. 18, the effectiveness of the present invention is shown in an experiment conducted during a casting campaign of a twin roll caster. The heat flux, represented in FIG. 18 as 'C' and 'D,' and the temperature of the casting rolls, represented in FIG. 18 as 'A' and 'B,' are being measured during the casting campaign in megawatts and degree F., respectively. The apparatus was similar to that illustrated in FIGS. 15 and 16. The point where nitrogen gas commenced being delivered to the casting surfaces is marked "N2 on" on FIG. 18. As shown the heat flux immediately began to rise and continued to rise until the gas was turned off at the second mark "N2 off" on FIG. 18, where the temperature of the casting rolls reached the control limits. This temperature limit was reached because the nitrogen gas it believed that atmospheric oxygen was introduced as a result into the gas layer, but the benefit of the present invention was confirmed by the experiment.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. A method of localized control of heat flux in continuous casting of thin cast strip comprising the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip to form a casting area;

assembling a rotating brush peripherally to contact the casting surface of each casting roll in advance of contact of the casting surfaces with the molten metal in the casting area;

removing oxides from the casting surface of each casting roll by contacting the casting surface of each casting roll with the rotating brush;

delivering gas at the casting surface adjacent the rotating brush to form a gas layer on the casting surface of each casting roll where the oxides have been removed; and counter-rotating the casting rolls such that the casting surfaces of the casting rolls each travel toward the nip to produce a cast strip downwardly from the nip.

2. The method of localized control of heat flux in continuous casting of thin cast strip as claimed in claim 1 wherein:

the delivering of the gas on the casting surface of each casting roll is adjacent the nip formed between the rotating cleaning brush and the casting surface of the casting roll.

3. The method of localized control of heat flux in continuous casting of thin cast strip as claimed in claim 1 wherein:

the step of delivering gas at the casting surface of each casting roll to replace the removed oxides comprises flooding the casting surfaces adjacent the rotating brushes with the gas.

4. The method of localized control of heat flux in continuous casting of thin cast strip as claimed in claim 1 wherein:

the step of delivering the gas to form a gas layer comprises introducing the gas into a housing provided about the rotating brush.

5. The method of localized control of heat flux in continuous casting of thin cast strip as claimed in claim 1 wherein:

the casting surfaces of the casting rolls are textured with a random distribution of discrete projections.

6. The method of localized control of heat flux the localized heat flux in continuous casting of thin cast strip as claimed in claim 1 wherein:

the gas comprises at least one gas selected from the group consisting of nitrogen, argon, hydrogen, helium, water vapor, dry air, carbon monoxide, carbon dioxide or a mixture of two or more thereof.

7. A method of localized control of heat flux in continuous casting of thin cast strip comprising the steps of:

assembling a pair of counter-rotating casting rolls laterally to form a nip between circumferential casting surfaces of the rolls through which metal strip may be cast;

forming a casting pool of molten metal supported on the casting surfaces of the casting rolls above the nip to form a casting area;

assembling a rotating brush peripherally to contact the casting surface of each casting roll in advance of contact of the casting surfaces with the molten metal in a casting area;

removing oxides from the casting surface of each casting roll by contacting the casting surface of each casting roll with the rotating brush;

delivering gas at the casting surface adjacent the rotating brush in at least three zones extending along the casting surfaces of the casting rolls to form a gas layer on the casting surface of each casting roll where the oxides have been removed; and counter-rotating the casting rolls such that the casting surfaces of the casting rolls each travel toward the nip to produce a cast strip downwardly from the nip.

8. The method of localized control of heat flux in continuous casting of thin cast strip as claimed in claim 7 wherein:

where the gas projected in the respective said at least three zones is different in composition, mixture, pressure, or at least two thereof.

9. The method of localized control of heat flux in continuous casting of thin cast strip as claimed in claim 7 wherein:

at least five zones are provided extending along the casting surfaces of the casting rolls.

10. The method of localized control of heat flux in continuous casting of thin cast strip as claimed in claim 8 wherein:

the delivering of the gas on the casting surface of each casting roll is adjacent the nip formed between the rotating cleaning brush and the casting surface of the casting roll.

11. The method of localized control of heat flux in continuous casting of thin cast strip as claimed in claim 8 wherein:

the step of delivering gas on the casting surface of each casting roll to replace the removed oxides comprises flooding the casting surfaces adjacent the rotating brushes with a gas.

12. The method of localized control of heat flux in continuous casting of thin cast strip as claimed in claim 8 wherein:

the step of delivering the gas to form a gas layer comprises introducing the gas into a housing provided about the rotating brush.

13. The method of localized control of heat flux in continuous casting of thin cast strip as claimed in claim 8 wherein:

the casting surfaces of the casting rolls are textured with a random distribution of discrete projections.

14. The method of localized control of heat flux the localized heat flux in continuous casting of thin cast strip as claimed in claim 8 wherein:

the gas comprises at least one gas selected from the group consisting of nitrogen, argon, hydrogen, helium, water vapor, dry air, carbon monoxide, carbon dioxide or a mixture of two or more thereof.

15. An apparatus for continuously casting thin cast strip with localized heat flux control comprising:

a pair of counter-rotating casting rolls having circumferential casting surfaces laterally spaced to form a nip therebetween through which thin cast strip may be discharged downwardly, and capable of supporting a casting pool of molten metal on the circumferential casting surfaces adjacent the nip to form a casting area;

rotating brushes capable of removing oxides from the casting surfaces of each casting roll positioned to remove such oxides from the casting surfaces in an area away from a casting area; and gas nozzles positioned along the casting surfaces of the casting rolls capable of directing gas on the casting surface of each casting roll adjacent the rotating brush to form a gas layer where oxides have been removed from the casting surfaces of the casting rolls.

16. The apparatus for continuously casting thin cast strip with localized heat flux control as claimed in claim 15 wherein:

the gas nozzles are capable of delivering the gas on the casting surface of each casting roll adjacent the nip formed between the rotating cleaning brush and the casting surface of the casting roll.

17. The apparatus for continuously casting thin cast strip with localized heat flux control as claimed in claim 15 wherein:

the gas nozzles are capable flooding the casting surfaces adjacent the rotating brushes with a gas.

18. The apparatus for continuously casting thin cast strip with localized control of heat flux as claimed in claim 15 comprising in addition:

a housing about the rotating brush, and the gas nozzle is capable of delivering the gas to form a gas layer is introduced through the housing.

19. The apparatus for continuously casting thin cast strip with localized control of heat flux as claimed in claim 15 wherein:

the casting surfaces of the casting rolls are textured with a random distribution of discrete projections.

20. The apparatus for continuously casting thin cast strip with localized control of heat flux as claimed in claim 15 wherein:

the gas comprises at least one gas selected from the group consisting of nitrogen, argon, hydrogen, helium, water vapor, dry air, carbon monoxide, carbon dioxide or a mixture of two or more thereof.

21. The apparatus for continuously casting thin cast strip with localized control of heat flux as claimed in claim 15 comprising in addition a control system comprising:

hydraulic motors capable of controlling the contact of the brush with the casting surface of each casting roll in advance of the casting area; and a monitoring device capable of monitoring the torque of the hydraulic motors to control the energy exerted by the rotating brushes against the casting surfaces of the casting rolls using the desired degree of cleaning as a reference to clean the expose a majority of projections of the casting surfaces of the casting rolls and provide wetting contact between the casting surface and the molten metal of the casting area.

22. The apparatus for continuously casting thin cast strip with control of localized heat flux as claimed in claim 21 where the monitoring device is capable of monitoring the torque of the hydraulic motors by measuring the pressure differential between inlet and outlet of hydraulic fluid through the hydraulic motors.

23. The apparatus for continuously casting thin cast strip with control of localized heat flux as claimed in claim 21 where the monitoring device is capable of measuring the torque between the hydraulic motor and a chock or a motor mount.

24. An apparatus for continuously casting thin cast strip with localized heat flux control comprising:

counter-rotating casting rolls having circumferential casting surfaces laterally spaced to form a nip therebetween through which thin cast strip may be discharged downwardly, and capable of supporting a casting pool on the circumferential casting surfaces adjacent the nip enclosed to form a casting area;

rotating brushes capable of removing oxides from the casting surfaces of each casting roll positioned to remove such oxides from the casting surfaces in an area away from the casting area; and gas nozzles capable of delivering gas at the casting surface adjacent the rotating brush in at least three zones extending along the casting surface of each casting roll to form a gas layer on the casting surface of each casting roll where the oxides have been removed.

25. The apparatus for continuously casting thin cast strip with localized heat flux control as claimed in claim 24 wherein:

the gas nozzles are capable of delivering in the respective said at least three zones different composition, mixture, pressure, or at least two thereof.

26. The apparatus for continuously casting thin cast strip with localized heat flux control as claimed in claim 24 wherein:

the gas nozzles are capable of delivering the gas on the casting surface in at least five zones along the axes of the casting rolls.

27. The apparatus for continuously casting thin cast strip with localized heat flux control as claimed in claim 24 wherein:

the gas nozzles are capable of delivering of the gas on the casting surface of each casting roll adjacent the nip formed between the rotating cleaning brush and the casting surface of the casting roll.

28. The apparatus for continuously casting thin cast strip with localized heat flux control as claimed in claim 24 wherein:

the gas nozzles are capable flooding the casting surfaces adjacent the rotating brushes with a gas.

29. The apparatus for continuously casting thin cast strip with localized control of heat flux as claimed in claim 24 comprising in addition:

a housing about the rotating brush, and the gas nozzle is capable of delivering the gas to form a gas layer introduced through the housing.

30. The apparatus for continuously casting thin cast strip with localized control of heat flux as claimed in claim 24 wherein:

the casting surfaces of the casting rolls are textured with a random distribution of discrete projections.

31. The apparatus for continuously casting thin cast strip with localized control of heat flux as claimed in claim 24 wherein:

the gas comprises at least one gas selected for the group consisting of: nitrogen, argon, hydrogen, helium, water vapor, dry air, carbon monoxide, carbon dioxide or a mixture of two or more thereof.

32. The apparatus for continuously casting thin cast strip with control heat flux as claimed in claim 24 comprising in addition a the control system comprising:

hydraulic motors capable of controlling the contact the casting surface of each casting roll with a rotating brush in advance of contact of the casting surfaces with the molten metal in the casting area; and a monitoring device capable of monitoring the hydraulic motors to control the energy exerted by the rotating brushes against the casting surfaces of the casting rolls using the desired degree of cleaning as a reference to clean the expose a majority of projections of the casting surfaces of the casting rolls and provide wetting contact between the casting surface and the molten metal of the casting area.

33. The apparatus for continuously casting thin cast strip claimed in claim 32 where the monitoring device is capable of monitoring the torque of the hydraulic motors by measuring the pressure differential between inlet and outlet of hydraulic fluid through the hydraulic motors.

34. The apparatus for continuously casting thin cast strip claimed in claim 32 where the monitoring device is capable of measuring the torque between the hydraulic motor and a chock or a motor mount.

* * * * *